US006022452A

United States Patent [19]

Caspar

[11] Patent Number: 6,022,452

[45] Date of Patent: Feb. 8, 2000

[54] APPARATUS FORE CUTTING AND THREADING A TAIL OF A TRAVELLING WEB IN A PAPERMAKING MACHINE

[76] Inventor: Roman C. Caspar, 21 Margaret Ann, Beaconsfield, Quebec, Canada, H9W 5N7

[21] Appl. No.: 08/929,292

[22] Filed: Sep. 5, 1997

[30] Foreign Application Priority Data

Jun. 20, 1997 [CA] Canada ..... 2080381

[51] Int. Cl.[7] ..... D21F 7/00

[52] U.S. Cl. ..... 162/286; 162/195; 162/255; 83/53; 83/156; 100/98 R

[58] Field of Search ..... 162/193, 194, 162/255, 286, 306, 264, 195, 197, 202; 100/97, 98 R; 83/53, 177, 156, 161

[56] References Cited

U.S. PATENT DOCUMENTS

| | | | |
|---|---|---|---|
| 1,279,756 | 9/1918 | Pope | 162/286 |
| 4,904,344 | 2/1990 | Peiffer . | |
| 4,918,836 | 4/1990 | Wedel . | |
| 4,931,140 | 6/1990 | Peltola et al. . | |
| 5,014,924 | 5/1991 | Nowisch et al. . | |
| 5,185,063 | 2/1993 | Aula et al. . | |
| 5,248,390 | 9/1993 | Fissmann et al. . | |
| 5,360,179 | 11/1994 | Vesterinen et al. . | |
| 5,407,587 | 4/1995 | Westerberg . | |
| 5,445,055 | 8/1995 | Koponen et al. . | |
| 5,622,601 | 4/1997 | Adams et al. . | |

FOREIGN PATENT DOCUMENTS

| | | |
|---|---|---|
| 9109313 | 9/1991 | Germany . |
| 4409660 | 8/1994 | Germany . |

*Primary Examiner*—Karen M. Hastings

[57] ABSTRACT

An apparatus for cutting a tail in a web sheet traveling through a nip between the queen roll and king roll of a calender includes a waterjet positioned adjacent the edge of the web upstream from the nip for directing a jet of water towards the web and the queen roll. The waterjet cuts a tip or leader and creates a tail that continues to travel with the remainder of the web sheet towards and through the nip. The waterjet penetrates the web and splashes against the queen roll such that the wetted portion of the queen roll compresses against the leader of the tail to carry or pull the tail around the queen roll. A doctor blade is mounted in engagement with the queen roll in line with the tail to direct the tail away from the queen roll and towards the next section of the papermaking machine. Guide trays positioned downstream of the doctor blade guide the tail to the next section of the papermaking machine. The doctor blade can be mounted stationary against the queen roll.

22 Claims, 4 Drawing Sheets

APPARATUS FORE CUTTING AND THREADING A TAIL OF A TRAVELLING WEB IN A PAPERMAKING MACHINE

FIELD OF THE INVENTION

The present invention relates to an apparatus for cutting and threading a tail from one section of a papermaking machine to a downstream section. In particular the present invention relates to the use of a waterjet cutting device to clip or chop the tail traveling through a calender or pull stack.

BACKGROUND OF THE INVENTION

In practice, after a paper break, the web is threaded in stages through the papermaking machine by cutting a tail and threading the tail through the machine. Any part of this threading process that can be automated is advantageous because it reduces downtime associated with web breakage. The term tail refers to an edge piece cut into the traveling web by means of a cut into the web from the edge of the web and a continuous slit along the web which forms the "tail" or "edge piece" of the paper web. This tail may be blown or directed into the next portion of the paper making machine at which time the remainder of the web is severed widening the tail, so that the tail pulls the web through the next portion of the machine to be threaded. Typically the tail is anywhere from 10 to 20 centimeters in thickness compared to the remainder of the width of the web which can be in the order of 7 meters.

In the calendering section of a paper machine, a leader, or tail is cut upstream of the calender anywhere from 10–20 centimeters in width and threaded through the calender stack into nips formed by two-, or several successive rolls of the calender, at which point it emerges from a last nip formed by an upper "queen roll" and a lower "king roll". As the tail passes through the last nip, the tail follows the king roll and is removed from the king roll by a doctor blade that directs the paper web into a broke pit. Once the tail is threaded through the last nip in the calender, the tail cutter upstream of the calender widens the web to full web width which can be in the order of 7–10 meters.

It is at this stage that the tail cutter upstream of the calender is cutting a new slit into the web which now follows through all nips and emerges at the king roll as a fresh tail. This new tail must be severed, or "chopped" in its cross width for threading into the next section of the papermaking machine such as a reel, winder, coater, or possibly a dryer section.

While the use of waterjet cutting devices to cut a tail in a papermaking machine has been disclosed in U.S. Pat. No. 4,931,140 issued Jun. 5, 1990 to Peltola et al, this patent is primarily concerned with moving the water jet back and forth at a suitable rate to reduce wetting of the web supporting felt. There is no teaching associated with how to use such a waterjet cutting device in association with tail cutting in a calender section of a papermaking machine where the web passes or travels over rolls in the papermaking machine and must be removed from those rolls.

An automatic web threading apparatus for a calender section of a papermaking machine is disclosed in U.S. Pat. No. 4,904,344 issued Feb. 27, 1990 to Robert E. Peiffer. This patent teaches using a foil that moves into engagement with the edge of the web passing over the king roll downstream of the nip between the queen and king rolls. The doctor blade associated with the king roll includes an air nozzle that directs air up towards the underside of web. The air nozzle and the foil combine to cause the edge of the paper web to lift off the king roll. A support plate tray carries a knife that moves the knife blade forward into contact with the edge of the paper lifted off the king roll to cut a tail from the edge of the paper. The knife is withdrawn and the tail travels over the support plate to the next section of the paper making machine. While this patent discloses an automatic tail cutter and threading apparatus, the patent requires the movement of a foil into contact or close proximity with the web at the king roll, an air nozzle and movement of a cutting blade into the web portion lifted off the first or king roll.

U.S. Pat. No. 5,622,601 issued Apr. 22, 1997 to Adams et al discloses a combination doctor and waterjet cutting device fixedly located relative to each other on a platform that moves laterally of a roll to clip a tail edge and remove the tail edge from the roll. In this arrangement both the waterjet and doctor blade move into position with the roll. This arrangement, however, does not allow for a reverse cut should a new tail need to clipped as a result of improper threading of the clipped tail downstream.

It would be an advantage over the above discussed automatic web threading apparatus to provide an automatic tail cutting, severing and threading apparatus for use in a calender section of a papermaking machine that does not require movement of apparatus, such as a foil or doctor blade, into position to effect clipping of a tail in a web or removal of the clipped tail since these moving parts complicate the machine and consume time to be moved into place. The quicker the tail can be cut from the web, the less paper is wasted during the threading process.

SUMMARY OF THE INVENTION

The present invention is directed to an apparatus for chopping a tail in a web sheet traveling through a nip between two rolls. A waterjet is positioned adjacent the edge of the web upstream from the nip. The waterjet directs a jet of water through the web and against the upper roll of two rolls. The waterjet travels relative to the edge of the web either into or out of the web to clip a tip in the tail that continues to travel with the remainder of the web sheet towards and through the nip. The waterjet penetrates the web and splashes against the one roll such that the wetted portion of the one roll compresses against the tip of the tail to carry or pull the tail around the one roll away from the other roll. The remainder of the non-wetted web sheet continues to follow the surface of the other roll. A doctor blade is mounted in engagement with the upper roll in line with the tail to direct the tail away from the upper roll and towards the next section of the papermaking machine.

By using the waterjet located upstream of the nip, the tail can be quickly chopped or clipped cut and the adhesion characteristics of the water on the one roll used to direct or draw the clipped tail over the one roll which is different from the other roll over which the remainder of the web travels. Further the direction of movement of the waterjet into or out of the web to clip the tail can be reversed anytime subsequent to the first tail being clipped to provide a second clipped tail in the event the first clipped tail is improperly threaded downstream.

By mounting the doctor blade against the one roll, which is the wetted roll, the doctor blade can be continuously maintained loaded in place against the one roll, and does not have to be moved either against the direction of web travel or laterally relative to the direction of web travel. While the doctor blade can be pivoted to load the blade against the one roll, the doctor blade is positioned away from the normal travel of the web and hence does not have to be moved out of engagement with the one roll. Hence, cutting and doctoring the tail against a roll different from the roll over which the remainder of the web sheet passes results in a less movably complex and cluttered calender section.

It should be understood that throughout the specification and claims that when reference is made to cutting a tail it is meant to be a thin edge slice of between 10 and 20 centimeters which may continue for anywhere from 10 to 50 feet, for example.

In accordance with one aspect of the present invention there is provided an apparatus for chopping a tail in a web in a calender section of a papermaking machine and for guiding the tail downstream to a next section. The calender section has a queen roll positioned vertically above a king roll to form a nip therebetween through which the web passes and follows the king roll. The improvement comprises a waterjet cutting device located upstream of the nip for directing a waterjet towards the web and the queen roll to chop the tail in the web leaving a main web portion. The waterjet wets the queen roll whereby the tail passes through the nip and adheres to the queen roll with the main web portion continuing to follow the king roll. A first doctor blade is located downstream of the nip adjacent the queen roll for picking up the tail from the queen roll after the tail passes through the nip.

While the present invention has been described in relation to the calender section of a papermaking machine, it should be understood that the present invention may have application in other parts of a papermaking or board making machine. Thus in accordance with another aspect of the present invention there is provided an apparatus for cutting a tail from a web in a first section of a papermaking machine and for guiding the tail downstream to a next section of the papermaking machine. The first section has a first roll positioned relative to a second roll to form a nip therebetween through which the web passes and follows the first roll. The improvement comprises a waterjet cutting device located upstream of the nip for directing a waterjet towards the web and the second roll to cut the tail in the web leaving a main web portion. The waterjet wets the second roll such that the tail passes through the nip and adheres to the second roll with the main web portion continuing to follow the first roll. The apparatus includes a doctor blade located downstream of the nip adjacent the second roll for picking up the tail from the second roll and guiding the tail towards the next section.

BRIEF DESCRIPTION OF THE DRAWINGS

For a better understanding of the nature and objects of the present invention reference may be had to the accompanying diagrammatic drawings in which.

DETAILED DESCRIPTION OF THE DRAWINGS

Figure 1:
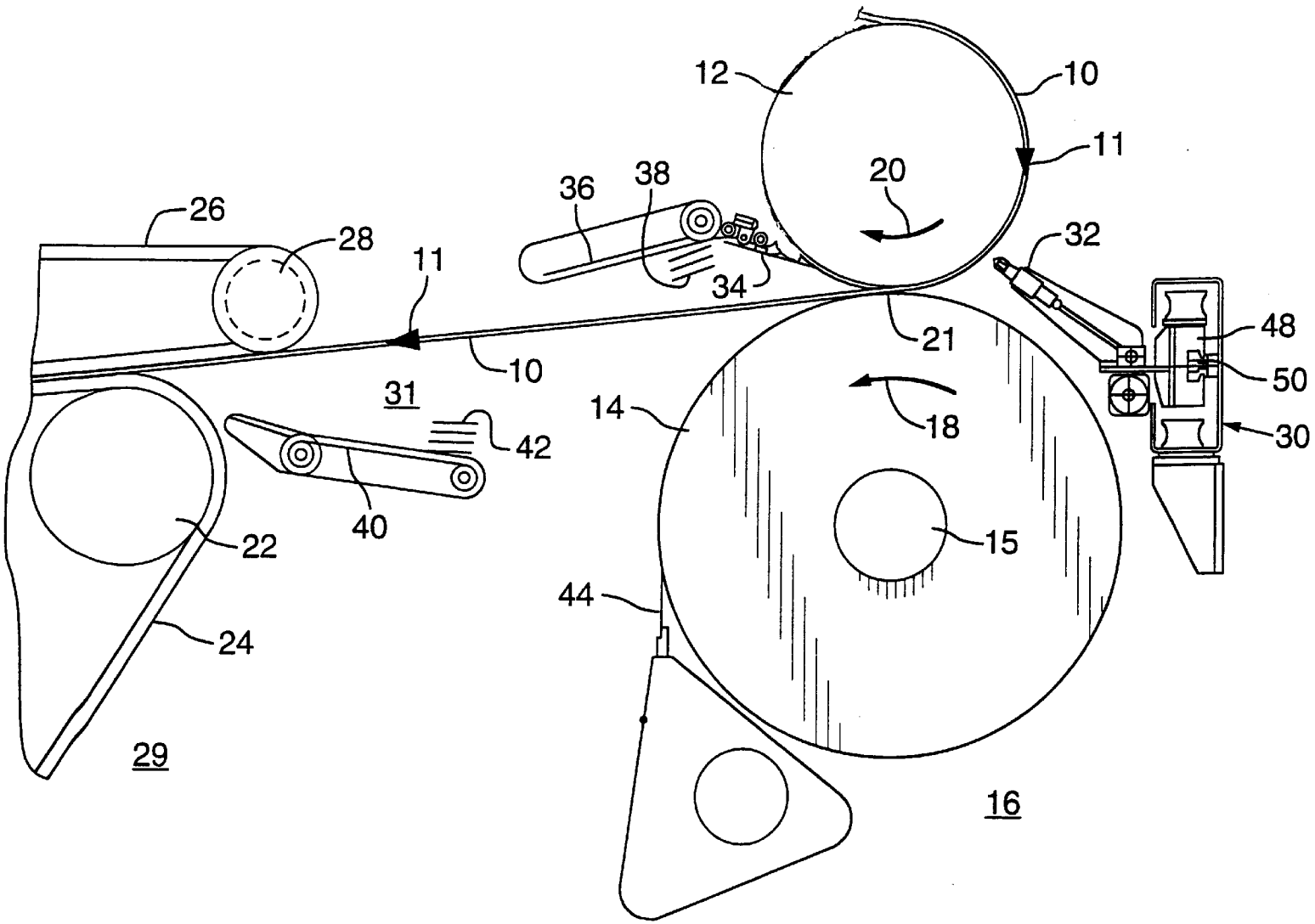
FIGS. 1 to 3 are side views of the apparatus of the present invention showing the web threading feature in various stages; and, FIG. 4 is a view similar to FIG. 3 showing an alternate embodiment.

Referring to FIG. 1 there is shown a paper web 10 moving in the direction of arrow 11 through a calender section 16 of a papermaking machine. The web 10 is shown to travel around the periphery of queen roll 12 and pass through nip 21 where queen roll 12 meets king roll 14. While only the queen roll 12 and the king roll 14 for the calender 16 are shown in the drawings, in practice there can be one or more stacking rolls located above the queen roll 12 through which the web 10 winds itself in a serpentine fashion. The king roll 14 is driven about shaft 15 causing the king roll 14 to rotate in the direction of arrow 18 and causing the queen roll 12 to rotate in the direction of arrow 20.

The web 10 leaving the nip 21 of the calender section 16 is transferred to roll 22 by being captured between one or more guide ropes 24 passing over roll 22 and the one or more guide ropes 26 passing around rope sheave 28. This section of the papermaking machine is referred to as the next section 29 of the machine. The web 10 is shown to travel over an open draw 31 between the calender section 16 and the next section 29.

Located upstream of the nip 21 is a waterjet apparatus 30 having a waterjet nozzle 32 pointing towards the web 10 and the queen roll 12. A first doctor blade 34 is located downstream of the nip 21 of the calender 16 positioned adjacent to and in engagement with the queen roll 12. The doctor blade 34 is located above and away from the normal travel 11 of web 10 through the calender section 16 and, hence, does not necessarily have to be moved into and out of engagement with the queen roll 12. The doctor blade 34 is followed by a first guide tray 36 against which an air shower 38 is directed in the direction of web travel upon demand. Continuing downstream in the direction of web travel is a second guide tray 40 also provided with an air shower 42 which can be directed against the tray 40 in the direction of travel of the web upon demand.

A second doctor blade 44 is located downstream of the nip 21 of the calender 16 and positioned against the king roll 14. The function of doctor blade 44 is explained hereafter.

The waterjet cutting device 30, first doctor 34, tray 36, and tray 40 are secured relative to an outside edge of the web 10. The mechanism these components in place may comprise any suitable means such as, for example a base stand secured to the floor having an arm extending laterally into the edge portion of the web 10. The waterjet cutting device or tail chopper 30 typically includes a movable carriage 48 movable along rail 50 laterally across the width of the tail 54. The waterjet cutting device 30 can be initially positioned adjacent the edge of the web 10 and moved laterally into the web 10 to clip the tail. Alternatively, the waterjet cutting device 30 can be initially positioned laterally inward from the edge of the web 10 and moved to the outside edge of the web to chop or clip the tail. Furthermore, this bi-directional movement capability of the waterjet cutting device 30 allows for a second tail to be clipped anytime after a first tail is clipped by reversing the direction of movement of the waterjet cutting device. There may be occasion to have to quickly chop a new tail in the event the previously chopped tail does not properly thread at some location downstream.

FIG. 1 of the drawings represents the scenario where the entire web has been threaded through to the next section of the papermaking machine and the web 10 is running during normal calendering operation.

Figure 2:
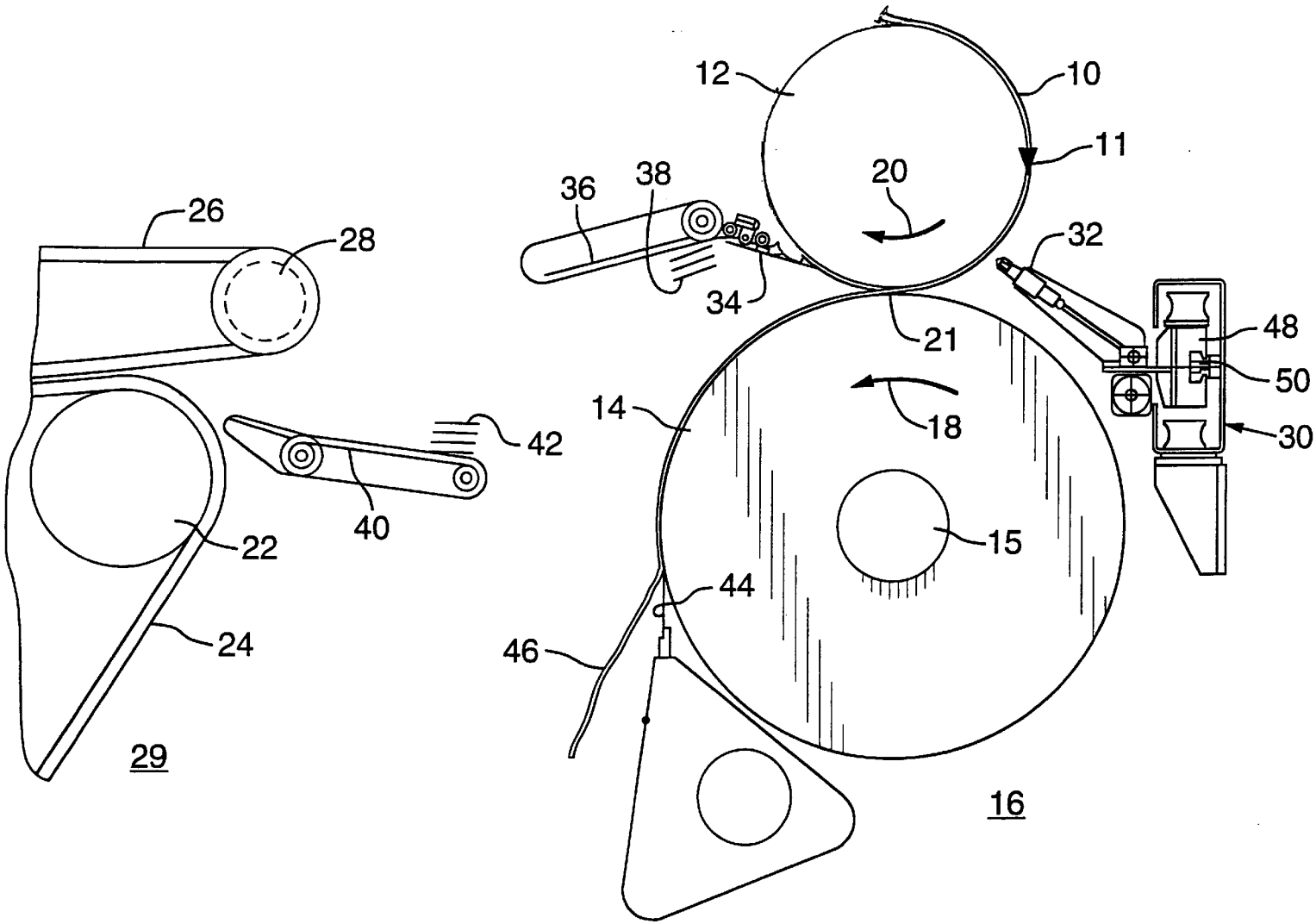

Referring to FIG. 2 of the drawings, there is shown the threading of the web 10 into the calender section 16. In this scenario the web 10 has been completely drawn through nip 21 and continues to follow king roll 14. Doctor blade 44 extends along the king roll 14 and scrapes the web 10 from the king roll 14. The web 10 is directed at 46 into a broke pit (not shown). Initially, a tail is fed through nip 21, over king roll 14 and into the broke pit.

Figure 3:
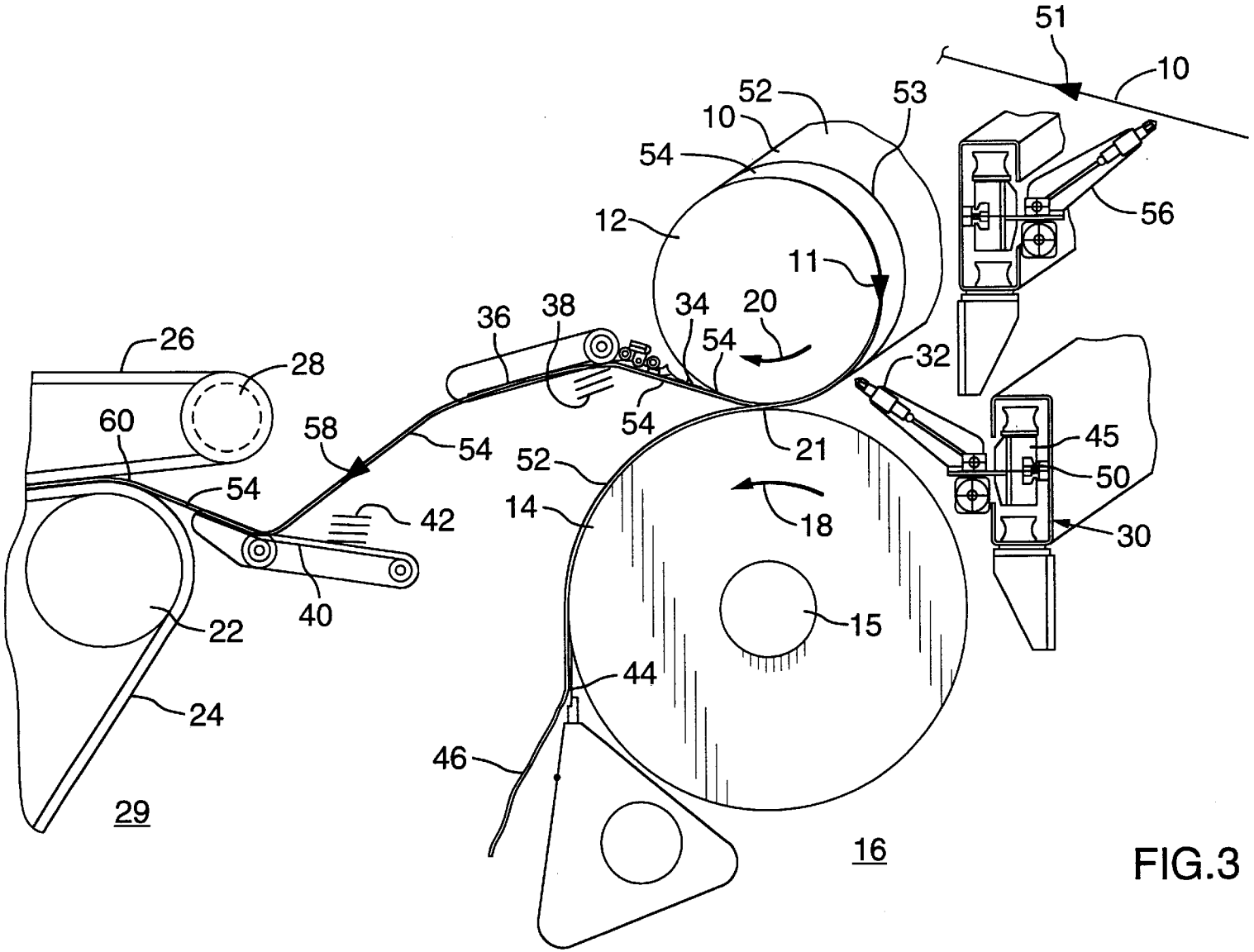

Referring to FIG. 3, the function of the tail cutting device and threading apparatus is described. In this Figure, the queen roll 12 is shown partially in a three dimensional perspective. The web 10 is shown for illustrative purposes to be moving toward queen roll 12 at arrow 51. In practice, web 10 at arrow 51 is moving toward the uppermost stacking roll (not shown) located in the calender section 16. The web 10 at arrow 51 has an edge slit cut about 10 to 20 centimeters in from the edge of the web 10 by means of a waterjet cutting device shown for illustrative purposes upstream at 56. The web 10 is slit once the entire web 10 has been threaded through nip 21 of the calender. The location of this waterjet 56 is upstream from the calender section 16 and may cut against either side of web 10. The web 10, shown passing over the top surface of queen roll 12, is divided by the slit 53 cut out in the web 10 by waterjet 56 into a main web portion 52 and an edge portion or trim portion 54. Once the web 10, with the slit 53, enters nip 21, or shortly thereafter, the waterjet 30 is operated to cut in, or chop, from the edge of the web 10 across the edge portion 54 and stopping its lateral cut at the slit 53. The waterjet 30 operating in this manner cuts a new tail to be threaded to the next section 29 of the papermaking machine. As the waterjet 30 cuts through the edge trim portion 54, the water jet splashes water against the queen roll 12. As the wet portion of queen roll 12 moves past nip 21 with the wet tail portion of the edge portion 54, adhesion occurs between the tail, or tip of the cut edge portion 54 and the queen roll 12. The tip of edge portion 54 then follows the surface of the queen roll 12 and is removed from the surface of queen roll 12 by doctor blade 34. Air shower 38 directs the tip edge portion 54 against tray 36 and the tip 54 continues in the direction of arrow 58 onto the lower tray 40. Air spray 42 directs the tip of edge portion 54 over the upwardly sloped end of lower tray 40 between ropes 24 and 26 as shown at contact point 60 in FIG. 3. Once the tail is caught between ropes 24 and 26 at 60, these ropes can be accelerated temporarily to straighten the edge portion 54 between the nip 21 and the point of contact 60 similar to that shown for web 10 in FIG. 1.

The main portion 52 of web 10 passing through nip 21 continues to follow the outside peripheral surface of king roll 14 and is scraped from king roll 14 by doctor blade 44 with the broke 46 entering the broke pit. The main portion 52 of the web 10 continues to follow the king roll even if a corner of the main portion 52 is wet because the main portion may extend for several feet which will pull any wet part of main portion 52 down into the broke pit.

Once the tail has been threaded and straightened from nip 21 to contact point 60 in the next section 29, then waterjet 56 moves laterally across web 10 widening the tail 54. As the tail or edge strip 54 widens, it is pulled through the next section 29 of the papermaking machine until the entire web 10 has been threaded into this next section 29 at point 60.

Figure 4:
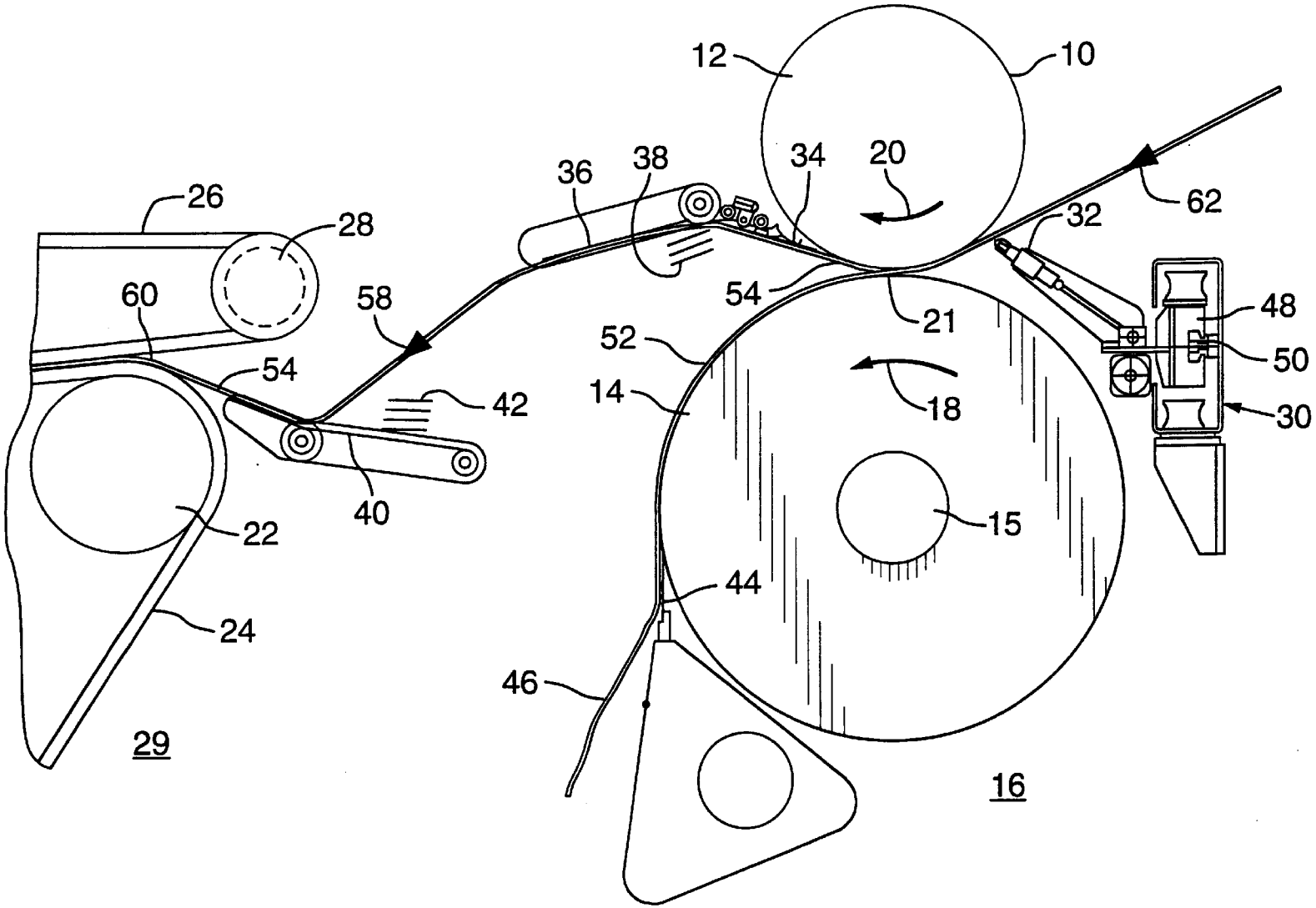

Referring to FIG. 4, alternate embodiments are shown. One alternative embodiment is to have web 10 entering nip 21 move in the direction of lead in arrow 62 which is angled away from the peripheral surface of queen roll 12. That is to say the web 10 does not wrap itself around the peripheral surface of queen roll 12. In this alternative embodiment, the web entering the nip 21 has already been slit upstream by another cutter (not shown). The waterjet 30 in this embodiment acts in the same manner as described for FIG. 3 which is to chop the tail tip and to wet the queen roll 12.

In a second alternative embodiment, the waterjet 30 acts to cut the tail end tip portion and maintain the slit. This might require two nozzles cooperating to cut the edge strip and also slit the web 10. This will wet the queen roll and once the tail 54 initially is threaded into contact point 60 of the next section 29, the waterjet cuts laterally across the main portion 52 of the web severing the web 10 and at the same time increasing the width of the tail or edge portion 54. It should be understood that the function of the waterjet cutting device 30 in this embodiment is not limited to cutting the web 10 angled away from the queen roll 12 as shown in FIG. 4 but rather can be used with the web 10 passing over the periphery surface of the queen roll 12 as illustrated in FIG. 3.

It should be understood that the width of the doctor blade 34 and trays 36 and 40 are chosen to be slightly wider than the width of the edge trim portion 54 slit in the web 10. Further, the doctor blade 34, and the trays 36 and 40 can be angled to keep the tail 54 directed to the outside edge of the web 10. The doctor blade 34 is shown in the drawings loaded in place against the queen roll 12. The doctor may be pivoted about point 64 by an air cylinder (not shown) into the loaded position or away from the queen roll 12 in an unloaded position. There is no lateral movement of the doctor blade 34 in from the outside edge of the calender.

While reference is made in the disclosure to a waterjet tail cutter located upstream of the calender section 16 for the purposes of slitting the web 10 and cutting a tail in the web 10 prior to entering the calender section 16, any other suitable cutting tool may be used for this purpose, such as, for example, a knife cutter.

What is claimed is:

1. An apparatus for chopping a first tail in a web in a first section of a papermaking machine and for guiding the first tail downstream to a next section of the papermaking machine, the first section having a first roll positioned relative to a second roll to form a nip therebetween through which and in direct contact therewith said web passes and follows the first roll, the improvement comprising:

a tail cutter located upstream said nip for slitting the web to form an edge web portion and a main web portion;

a waterjet cutting device located upstream of and adjacent to said nip having a nozzle oriented toward the edge web portion and the second roll for directing a waterjet towards said edge web portion and said second roll to sever the edge web portion and form the first tail in said web prior to said nip, and said waterjet wetting said second roll whereby the first tail passes through said nip and adheres to said second roll separating from the main web portion which continues to follow the first roll; and, a first doctor device located downstream of said nip adjacent said second roll for picking up the first tail from the second roll and guiding the first tail towards the next section.

2. The apparatus of claim 1 further including a first guide tray adjacent said first doctor device for guiding the first tail downstream away from the first section towards the second section.

3. The apparatus of claim 2 further including a second guide tray located downstream of said first guide tray for guiding the first tail downstream towards the second section.

4. The apparatus of claim 2 wherein said first guide tray comprises a relatively flat tray having an air shower directed along the tray in the direction of web travel.

5. The apparatus of claim 3 wherein the first and second guide trays comprise a relatively flat tray having an air shower directed along the tray in the direction of web travel.

6. The apparatus of claim 1 wherein said first doctor device is movable between a loaded position engaging the second roll and an unloaded position spaced from said second roll, said first doctor device having a blade adapted to engage the second roll across the width of the first tail when the first doctor device is in the loaded position.

7. The apparatus of claim 1 wherein the waterjet cutting device temporarily directs a jet of water against the web to sever the edge web portion.

8. The apparatus of claim 7 wherein the tail cutter located upstream of the nip in the papermaking machine severs the main web portion after the first tail passes through the nip and is threaded into the next section of the papermaking machine.

9. The apparatus of claim 1 wherein the web travels over the second roll prior to the nip.

10. The apparatus of claim 1 wherein said web is spaced from said second roll prior to entering the nip.

11. An apparatus for chopping a first tail in a web in a calender section of a papermaking machine and for guiding the first tail downstream to a next section, the calender section having a queen roll positioned vertically above a king roll to form a nip therebetween through which and in direct contact therewith said web passes and follows the king roll, the improvement comprising:

a tail cutter located upstream said nip for slitting the web to form an edge web portion and a main web portion;

a waterjet cutting device located upstream of and adjacent to said nip having a nozzle oriented toward the edge web portion and the queen roll for directing a waterjet towards said edge web portion and said queen roll to sever the edge web portion and form the first tail in said web prior to said nip, and the waterjet wetting said queen roll whereby the first tail passes through said nip and adheres to said queen roll separating from the main web portion which continues to follow the king roll; and, a first doctor blade located downstream of said nip adjacent said queen roll for picking up said first tail from said queen roll after said first tail passes through said nip.

12. The apparatus of claim 11 further including a first guide tray adjacent said first doctor blade for guiding the first tail downstream away from the calender section towards the next section.

13. The apparatus of claim 12 further including a second guide tray located downstream of said first guide tray for guiding the first tail downstream towards the next section.

14. The apparatus of claim 12 wherein said first guide tray comprises a relatively flat tray having an air shower directed along the tray in the direction of web travel.

15. The apparatus of claim 13 wherein the first and second guide trays comprise a relatively flat tray having an air shower directed along the tray in the direction of web travel.

16. The apparatus of claim 11 wherein the waterjet cutting device temporarily directs a jet of water against the web to sever the edge web portion.

17. The apparatus of claim 11 wherein the tail cutter located upstream of the nip in the papermaking machine severs the major web portion after the first tail passes through the nip and is threaded into the next section of the papermaking machine.

18. The apparatus of claim 11 wherein the web travels over the queen roll prior to the nip.

19. The apparatus of claim 11 wherein said web is spaced from said queen roll prior to entering the nip.

20. The apparatus of claim 11 including a second doctor blade located adjacent the king roll for scraping the main web portion from said king roll.

21. The apparatus of claim 11 wherein the waterjet cutting apparatus is bi-directionally movably laterally across the web so that direction of movement of the waterjet cutting apparatus can be reversed to chop a second tail after the first tail has been chopped.

22. The apparatus of claim 1 wherein the waterjet cutting apparatus is bi-directionally movably laterally across the web so that direction of movement of the waterjet cutting apparatus can be reversed to chop a second tail after the first tail has been chopped.

* * * * *

UNITED STATES PATENT AND TRADEMARK OFFICE

CERTIFICATE OF CORRECTION

PATENT NO. : 6,022,452

DATED : February 8, 2000

INVENTOR(S) : CASPAR

It is certified that error appears in the above-identified patent and that said Letters Patent is hereby corrected as shown below:

Claim 1, line 8, after "upstream" insert --of--.
Claim 11, line 8, after "upstream" insert --of--.
In the title delete "FORE" and insert --FOR--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*